US011377827B2

(12) United States Patent
Lee et al.

(10) Patent No.: US 11,377,827 B2
(45) Date of Patent: Jul. 5, 2022

(54) POSITIONING HOSE STRUCTURE FOR PULL-OUT FAUCET

(71) Applicant: Ching Shenger Co., Ltd., Xianxi Township, Changhua County (TW)

(72) Inventors: Chin-Tsai Lee, Xianxi Township (TW); Ming-Che Lee, Xianxi Township (TW)

(73) Assignee: Ching Shenger Co., Ltd., Xianxi Township (TW)

( * ) Notice: Subject to any disclaimer, the term of this patent is extended or adjusted under 35 U.S.C. 154(b) by 219 days.

(21) Appl. No.: 16/892,537

(22) Filed: Jun. 4, 2020

(65) Prior Publication Data

US 2021/0381208 A1 Dec. 9, 2021

(51) Int. Cl.
*E03C 1/02* (2006.01)
*E03C 1/04* (2006.01)

(52) U.S. Cl.
CPC ..... *E03C 1/021* (2013.01); *E03C 1/0404* (2013.01); *E03C 2001/0415* (2013.01)

(58) Field of Classification Search
CPC . E03C 1/021; E03C 1/0404; E03C 2001/0415
USPC ..... 4/678
See application file for complete search history.

(56) References Cited

U.S. PATENT DOCUMENTS

2008/0196160 A1* 8/2008 Alder ..... F16L 11/16 4/678
2016/0215482 A1* 7/2016 Fourman ..... E03C 1/0404
2020/0123741 A1* 4/2020 Huang ..... E03C 1/0404

* cited by examiner

*Primary Examiner* — Huyen D Le
(74) *Attorney, Agent, or Firm* — Karin L. Williams; Alan D. Kamrath; Mayer & Williams PC

(57) ABSTRACT

A positioning hose structure for a pull-out faucet contains: a body, a supply pipe, a fitting sleeve, a flexible hose, a guide element, a slide member, and a spring. The body includes a locking portion, and the supply pipe includes an extension, an opening, a defining portion, and a screw element. The fitting sleeve includes a hollow connection tube having a through hole, a receiving orifice, a shoulder, multiple protrusions, and multiple guiding slots. The flexible hose includes a joining portion and a water supply head. The guide element includes a fixing orifice having a positioning portion, and the guide element further includes multiple first ribs and a first toothed portion. The slide member includes multiple second ribs, a second toothed portion, and a protruded tab. The spring is accommodated in the receiving orifice and abuts against the shoulder and the protruded tab.

5 Claims, 12 Drawing Sheets

POSITIONING HOSE STRUCTURE FOR PULL-OUT FAUCET

BACKGROUND OF THE INVENTION

Field of the Invention

The present invention relates to a faucet, and more particularly to a positioning hose structure for a pull-out faucet.

Description of the Prior Art

Faucet is one of the indispensable water supply tools in human life, and a development of faucets has led to advancement to an application of washing. For example, a structure design of different faucets is gradually applied on a sink, a countertop, and washstand, thus providing consumers with more diversified appearances. With these faucets designed for special purposes, it is more convenient for people to use water.

Conventionally, the faucets installed on the countertop are designed in vertical type. For a convenience of water control, a water control valve is often designed to be located beside a body of a faucet, and a supply pipe is located on a top of the body. However, it is required to washing the countertop after using the countertop. When washing the countertop with the faucet, the supply pipe cannot be pulled to the countertop. To overcome this problem, a faucet with a flexible hose has been developed, wherein the flexible hose is received in the supply pipe, a first end of the flexible hose is inserted through the body to connect with a threaded tube of a water control valve, and a second end of the flexible hose is coupled with a water supply head, wherein the water supply head is fitted on an outer wall of the water supply pipe, such that when washing the countertop or other objects in a large size, the flexible hose is pulled to extend the water supply head to a desired position.

But after pulling the water supply head of the faucet outward, it cannot be mounted by a fixing structure, and it is required to keep pulling the water supply head outward, thus operating the water supply head inconveniently and laboriously. Nevertheless, the flexible hose is inserted through the body, so the water control valve, an inlet pipe, and the water supply pipe are accommodated in limited space so that the flexible hose is received in the body, and a counter weight is fixed on the flexible hose. When pulling the flexible hose downward by ways of the counterweight, a size of the body of the faucet is quite large, the space is limited, and the flexible hose is bendable, so the flexible hose is stopped by the water control valve, when inserting the flexible hose into the body from an end of the water supply pipe, thus causing difficult installation and obstructing the flexible hose in the body.

The present invention has arisen to mitigate and/or obviate the afore-described disadvantages.

SUMMARY OF THE INVENTION

The primary object of the present invention is to provide a positioning hose structure for a pull-out faucet which contains a water supply head positioned automatically after being pulled outwardly, thus obtaining easy operation.

Further object of the present invention is to provide a positioning hose structure for a pull-out faucet which contains a body not changed its structure, and a size of the body is decreased to achieve easy fabrication and wide commonality.

Another object of the present invention is to provide a positioning hose structure for a pull-out faucet which contains a flexible hose not inserted through the body so as to connect and maintain a faucet easily.

To achieve above-mentioned objectives, a positioning hose structure for a pull-out faucet provided by the present invention contains: a body, a supply pipe, a fitting sleeve, a flexible hose, a guide element, a slide member, and a spring.

The body includes a locking portion formed on a top thereof.

The supply pipe is hollow and includes an extension formed on a first end thereof, an opening defined on a second end of the supply pipe, a defining portion formed on a bottom of the extension, a screw element locked on an outer wall of the defining portion. The defining portion is screwed with the outer threads of the locking portion of the body by using the screw element of the body.

The fitting sleeve includes a hollow connection tube fitted with an inner wall of the extension of the supply pipe. The connection tube has a through hole defined adjacent to an upper end thereof, a receiving orifice connecting and communicating with the coupling portion, a shoulder arranged on an upper end of the receiving orifice, multiple protrusions separately formed on an inner wall of the through hole, and multiple guiding slots. A respective guiding slot is defined between any two adjacent protrusions.

The flexible hose is slidably accommodated in the supply pipe, and the flexible hose includes a joining portion formed on a first end thereof. The joining portion has a stop ridge formed thereon and is inserted into the connection tube, the flexible hose further includes a water supply head arranged on a second end thereof and located outside the supply pipe, and the water supply head is engaged with the opening of the supply pipe and is pulled outward with the flexible hose.

The guide element includes a fixing orifice defined on a center of the guide element and configured to rotatably and movably fit with an outer wall of the joining portion of the flexible hose. The fixing orifice has a positioning portion extending from a bottom of an inner wall thereof, the guide element further includes multiple first ribs separately arranged around the guide element, and the guide element includes a first toothed portion successively formed on a bottom thereof.

The slide member is formed in a hollow tube shape and is slidably received in the connection tube. The slide member includes an inner wall of a top connected with the joining portion of the flexible hose, multiple second ribs separately arranged on an outer wall of the top of the slide member, a second toothed portion formed on the top of the multiple second ribs, and a protruded tab extending around a bottom of the slide member, contacting with and sliding along the inner wall of the connection tube.

The spring is accommodated in the receiving orifice of the connection tube and is fitted on outer sides of the flexible hose and the slide member. A first end of the spring abuts against the shoulder of the upper end of the receiving orifice, and a second end of the spring contacts with the protruded tab of the bottom of the slide member.

DETAILED DESCRIPTION OF THE PREFERRED EMBODIMENTS

The present invention will be clearer from the following description when viewed together with the accompanying drawings, which show, for purpose of illustrations only, a preferred embodiment in accordance with the present invention.

Figure 1:
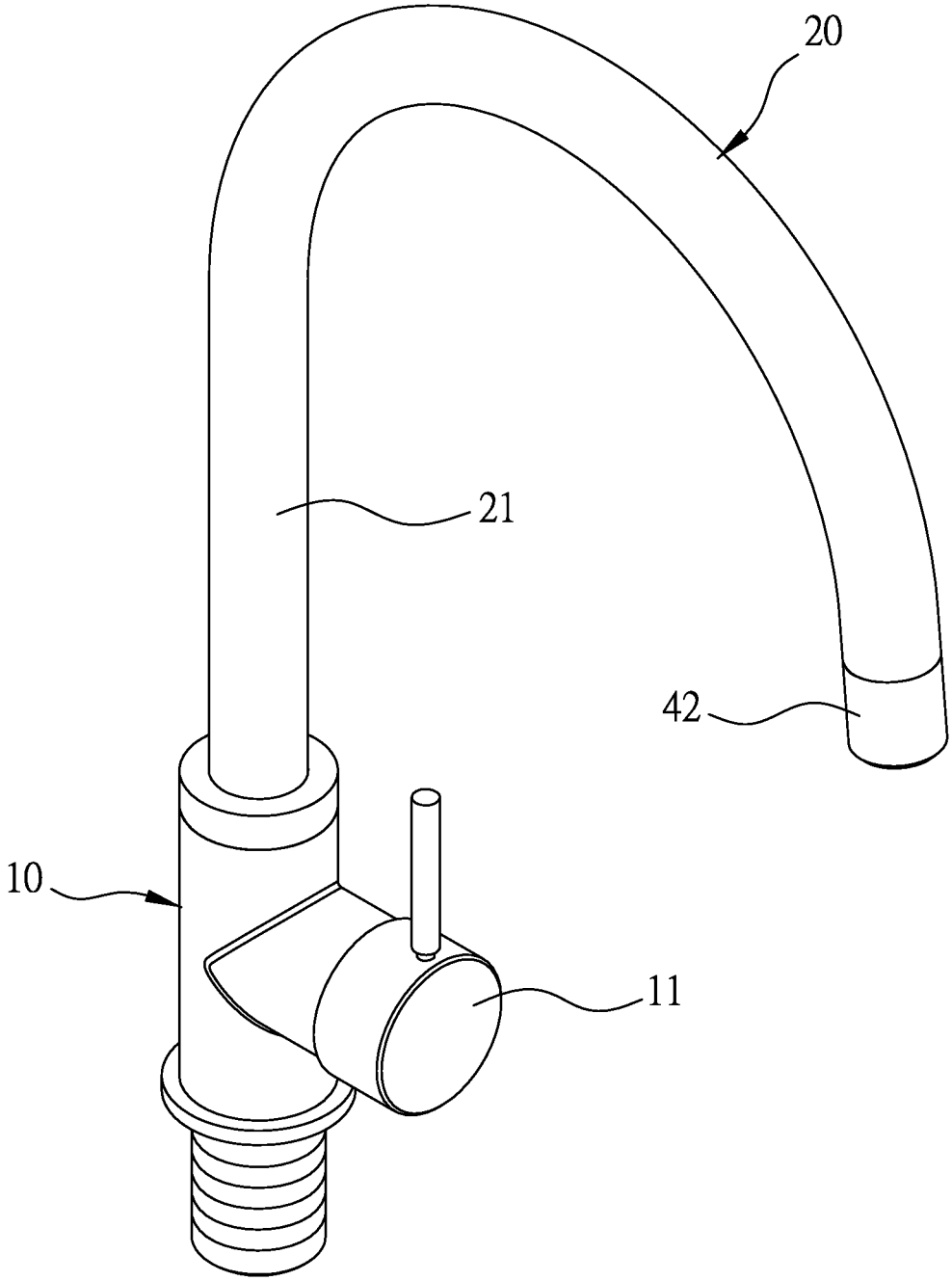
FIG. 1 is a perspective view showing the assembly of a positioning hose structure for a pull-out faucet according to a preferred embodiment of the present invention.
Figure 2:
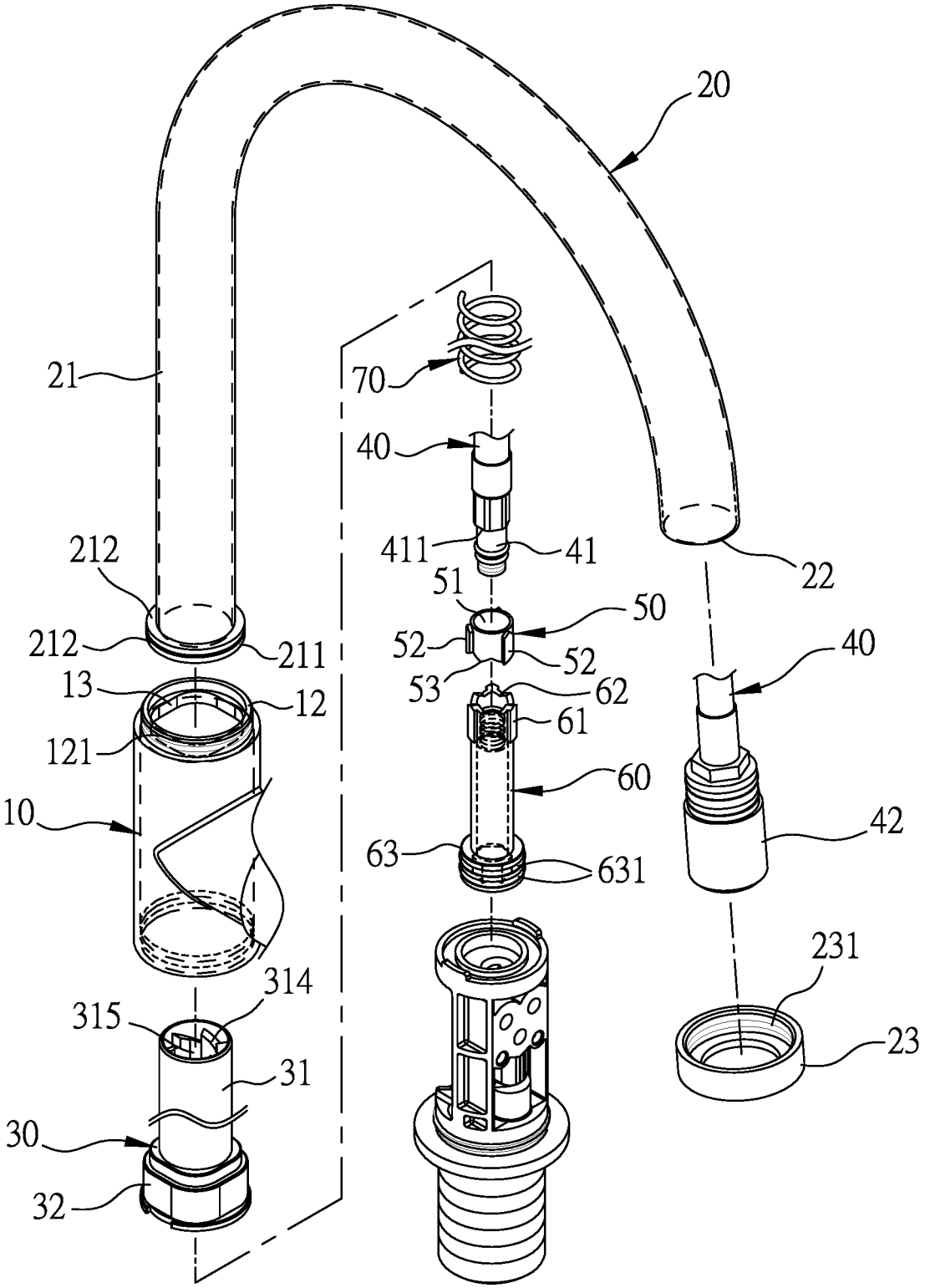
FIG. 2 is a perspective view showing the exploded components of the positioning hose structure for the pull-out faucet according to the preferred embodiment of the present invention.
Figure 3:
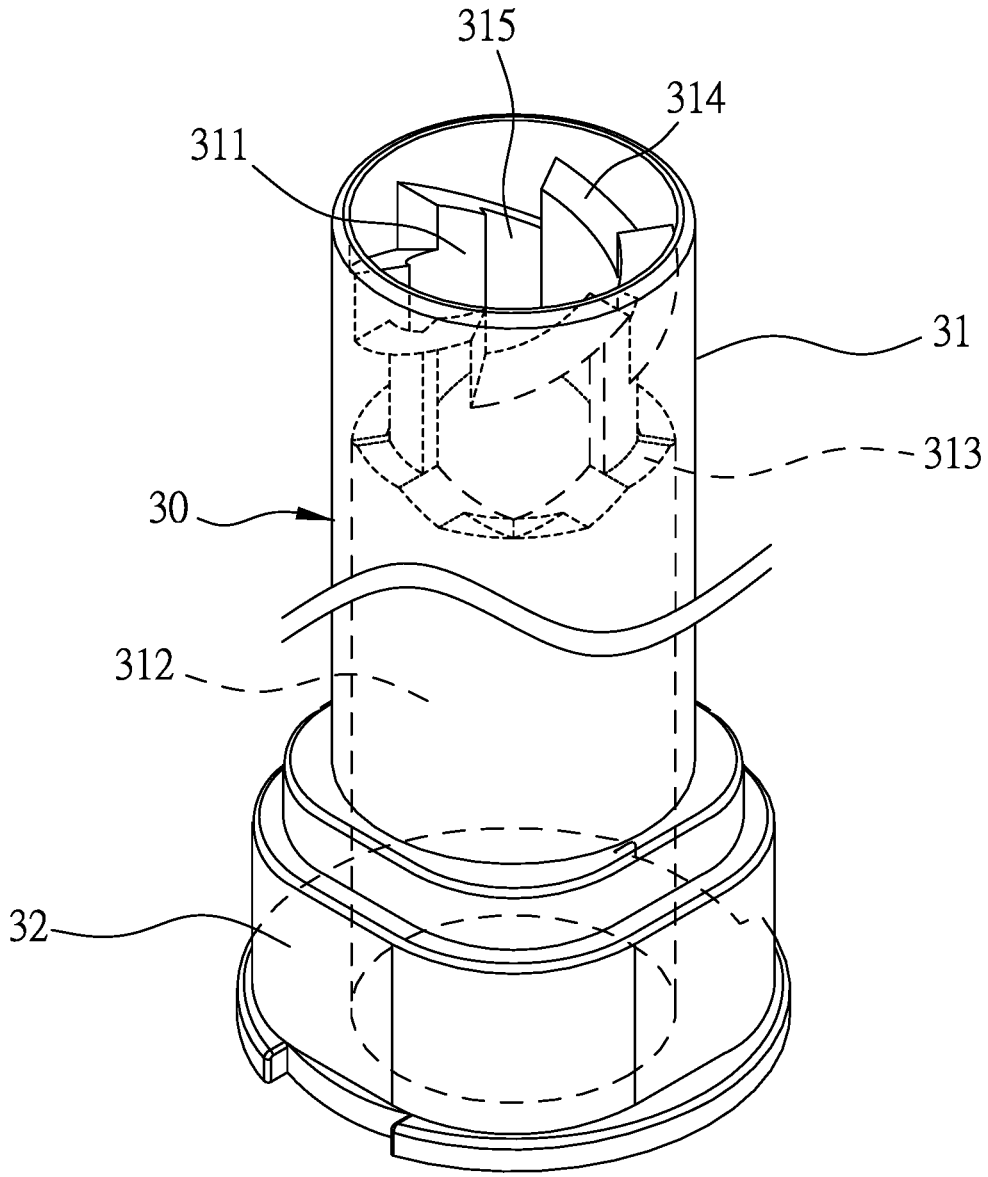
FIG. 3 is a perspective view showing the assembly of a part of the positioning hose structure for the pull-out faucet according to the preferred embodiment of the present invention.
Figure 4:
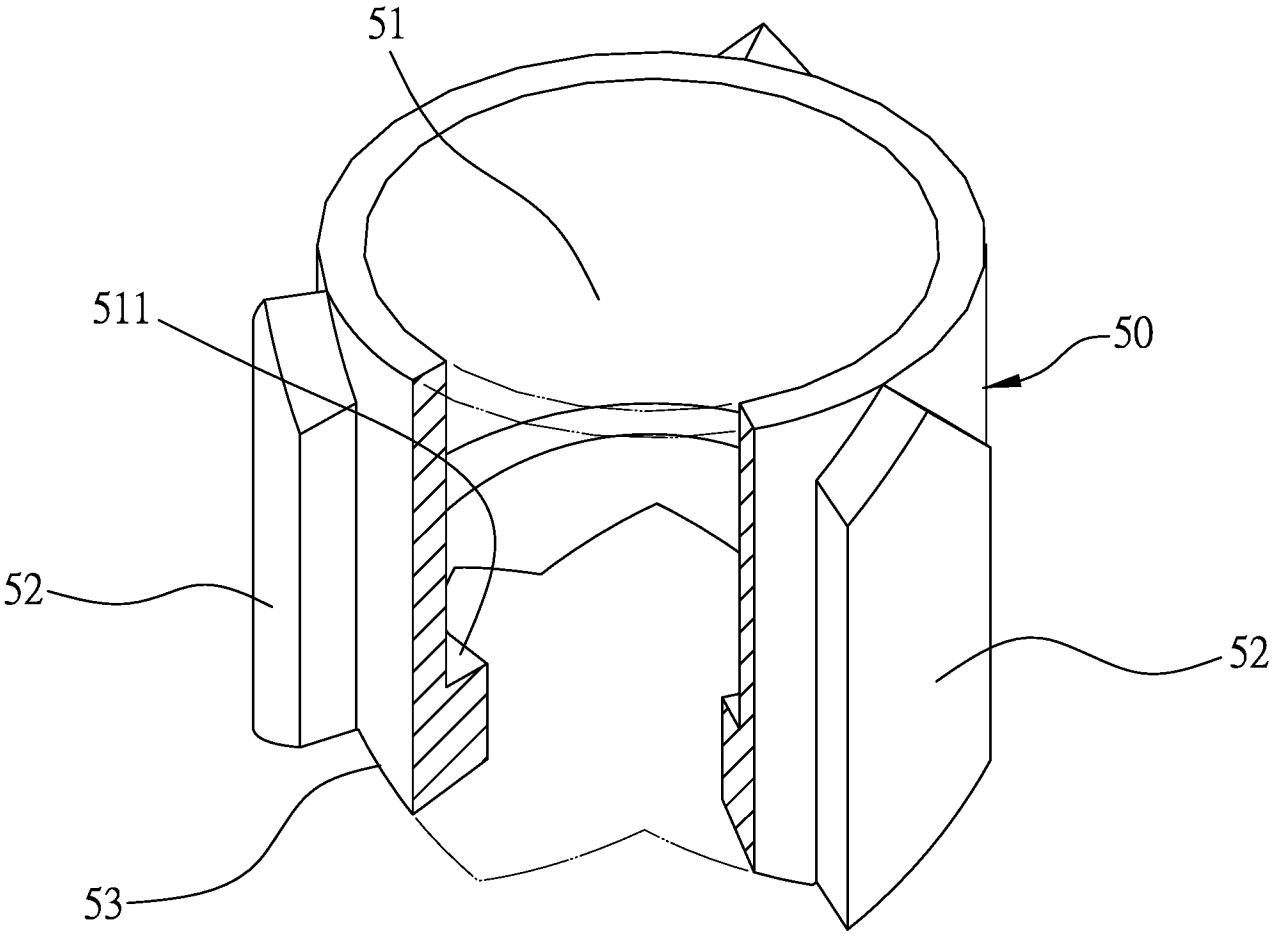
FIG. 4 is a cross-sectional perspective view showing the assembly of a part of the positioning hose structure for the pull-out faucet according to the preferred embodiment of the present invention.
Figure 5:
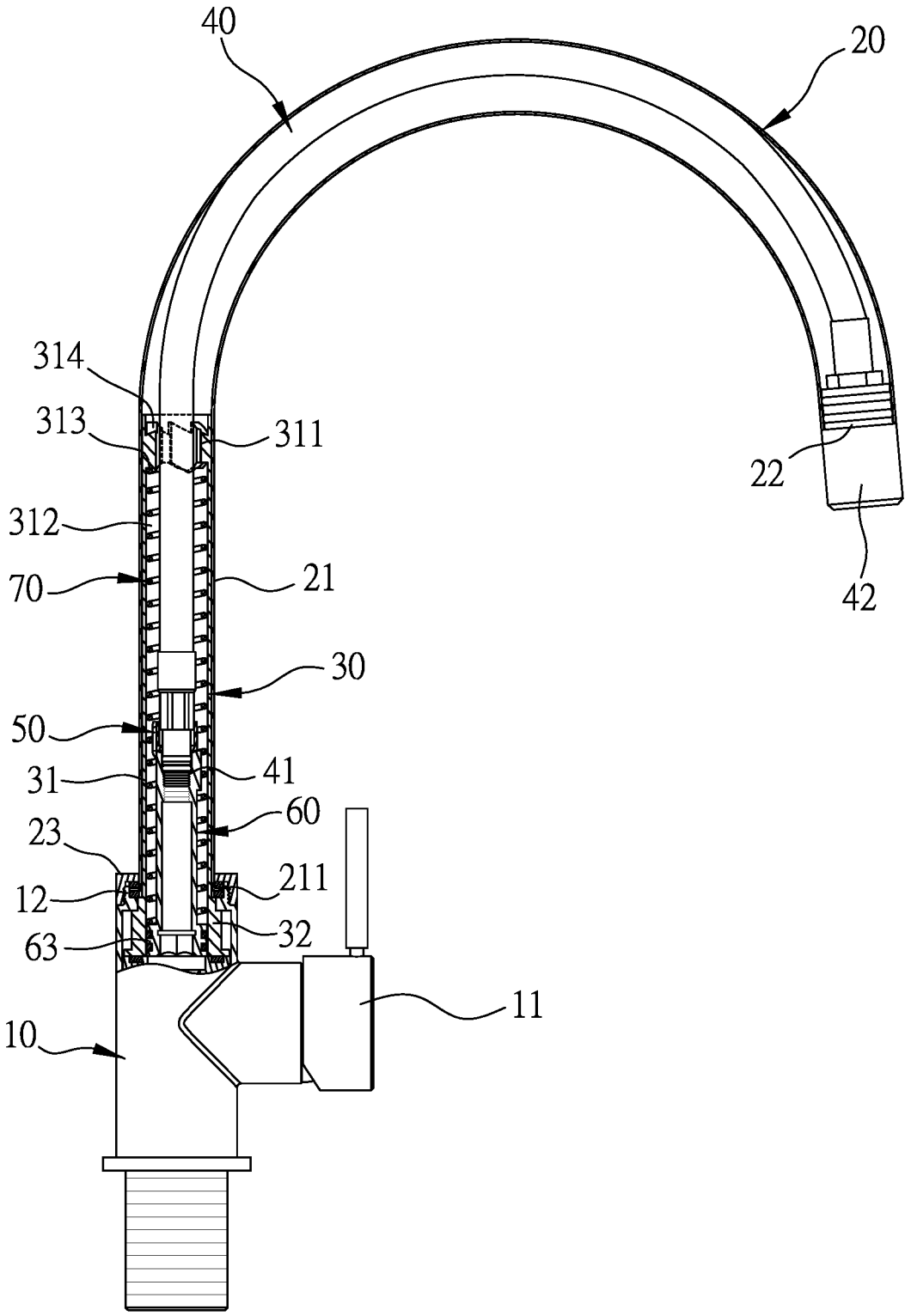
FIG. 5 is a cross-sectional view showing the assembly of the positioning hose structure for the pull-out faucet according to the preferred embodiment of the present invention.
Figure 6:
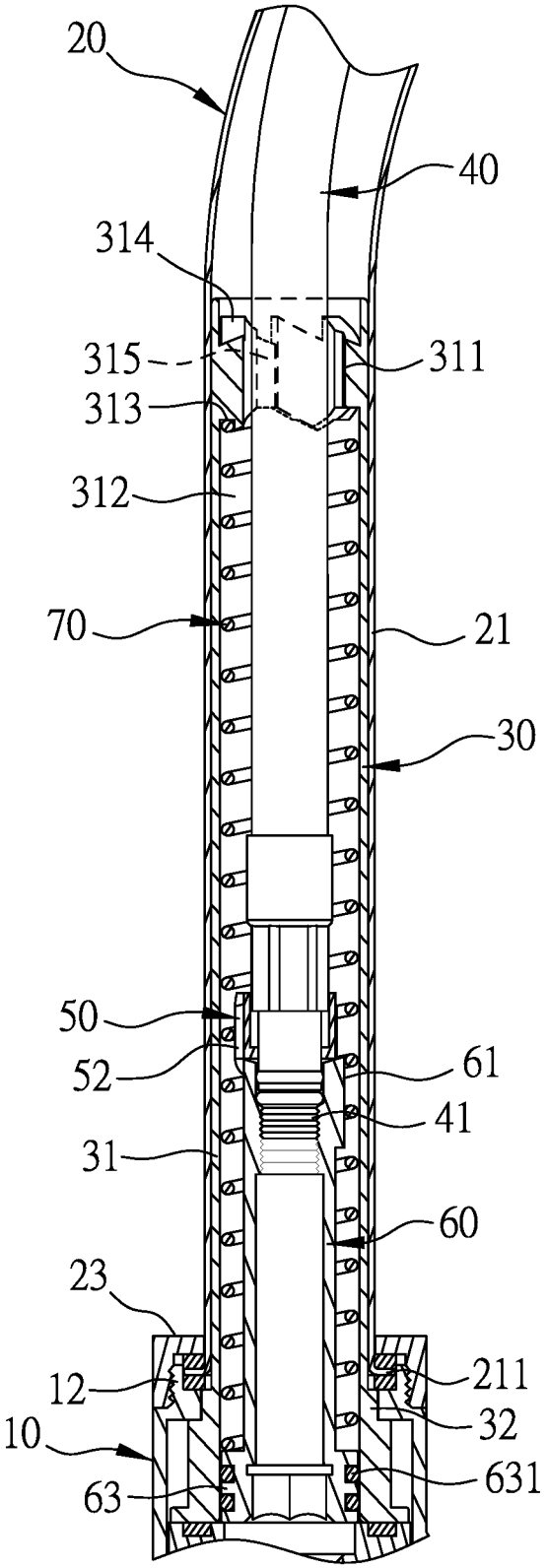
FIG. 6 is an amplified cross-sectional view of a part of FIG. 5.

With reference to FIGS. 1-6, a positioning hose structure for a pull-out faucet according to a preferred embodiment of the present invention comprises: a body 10, a supply pipe 20, a fitting sleeve 30, a flexible hose 40, a guide element 50, a slide member 60, and a spring 70.

The body 10 includes a control portion 11 configured to control water supply and mounted on a side of the body 10, a locking portion 12 formed on a top of the body 10, and a connecting portion 13 arranged on an inner wall of the top of the body 10, wherein the locking portion 12 has outer threads 121 formed on an outer wall thereof.

The supply pipe 20 is hollow, and the supply pipe 20 includes an extension 21 formed on a first end thereof, an opening 22 defined on a second end of the supply pipe 20, a defining portion 211 formed on a bottom of the extension 21, a screw element 23 locked on an outer wall of the defining portion 211, the defining portion 211 being circularly protruded, and two first seal rings 212 fitted on an upper end and a lower end of the defining portion 211 respectively, and the screw element 23 has inner threads 231 defined on an inner wall thereof, such that the defining portion 211 is screwed with the outer threads 121 of the locking portion 12 of the body 10 by using the inner threads 231 of the screw element 23, the supply pipe 20 is connected with the body 10, and the two first seal rings 212 of the defining portion 211 stop a water leakage.

The fitting sleeve 30 includes a hollow connection tube 31 and a coupling portion 32 extending from a bottom of the connection tube 31, wherein the connection tube 31 is fitted with an inner wall of the extension 21 of the supply pipe 20, and the coupling portion 32 of the connection tube 31 is fitted with the connecting portion 13 of the body 10, wherein the connection tube 31 has a through hole 311 defined adjacent to an upper end thereof, a receiving orifice 312 connecting and communicating with the coupling portion 32, a shoulder 313 arranged on an upper end of the receiving orifice 312, multiple protrusions 314 separately formed on an inner wall of the through hole 311, and multiple guiding slots 315, wherein a respective guiding slot 315 is defined between any two adjacent protrusions 314.

The flexible hose 40 is slidably accommodated in the supply pipe 20, and the flexible hose 40 includes a joining portion 41 formed on a first end thereof, wherein the joining portion 41 has a stop ridge 411 formed thereon and is inserted into the connection tube 31, the flexible hose 40 further includes a water supply head 42 arranged on a second end thereof and located outside the supply pipe 20, and the water supply head 42 is engaged with the opening 22 of the supply pipe 20 and is pulled outward with the flexible hose 40.

The guide element 50 includes a fixing orifice 51 defined on a center thereof and configured to rotatably and movably fit with an outer wall of the joining portion 41 of the flexible hose 40, wherein the fixing orifice 51 has a positioning portion 511 extending from a bottom of an inner wall of the fixing orifice 51, the guide element 50 further includes multiple first ribs 52 separately arranged around the guide element 50, and the guide element 50 includes a first toothed portion 53 successively formed on a bottom thereof.

The slide member 60 is formed in a hollow tube shape and is slidably received in the connection tube 31, the slide member 60 includes an inner wall of a top connected with the joining portion 41 of the flexible hose 40, multiple second ribs 61 separately arranged on an outer wall of a top of the slide member 60, a second toothed portion 62 formed on the top of the multiple second ribs 61, and a protruded tab 63 extending around a bottom of the slide member 60, wherein the protruded tab 63 has at least one second seal ring 631 (in this embodiment, two second seal rings 631 are fitted on the protruded tab 63) contacting with an inner wall of the connection tube 31.

The spring 70 is accommodated in the receiving orifice 312 of the connection tube 31 and is fitted on outer sides of the flexible hose 40 and the slide member 60, wherein a first end of the spring 70 abuts against the shoulder 313 of the upper end of the receiving orifice 312, and a second end of the spring 70 contacts with the protruded tab 63 of the bottom of the slide member 60.

Figure 7:
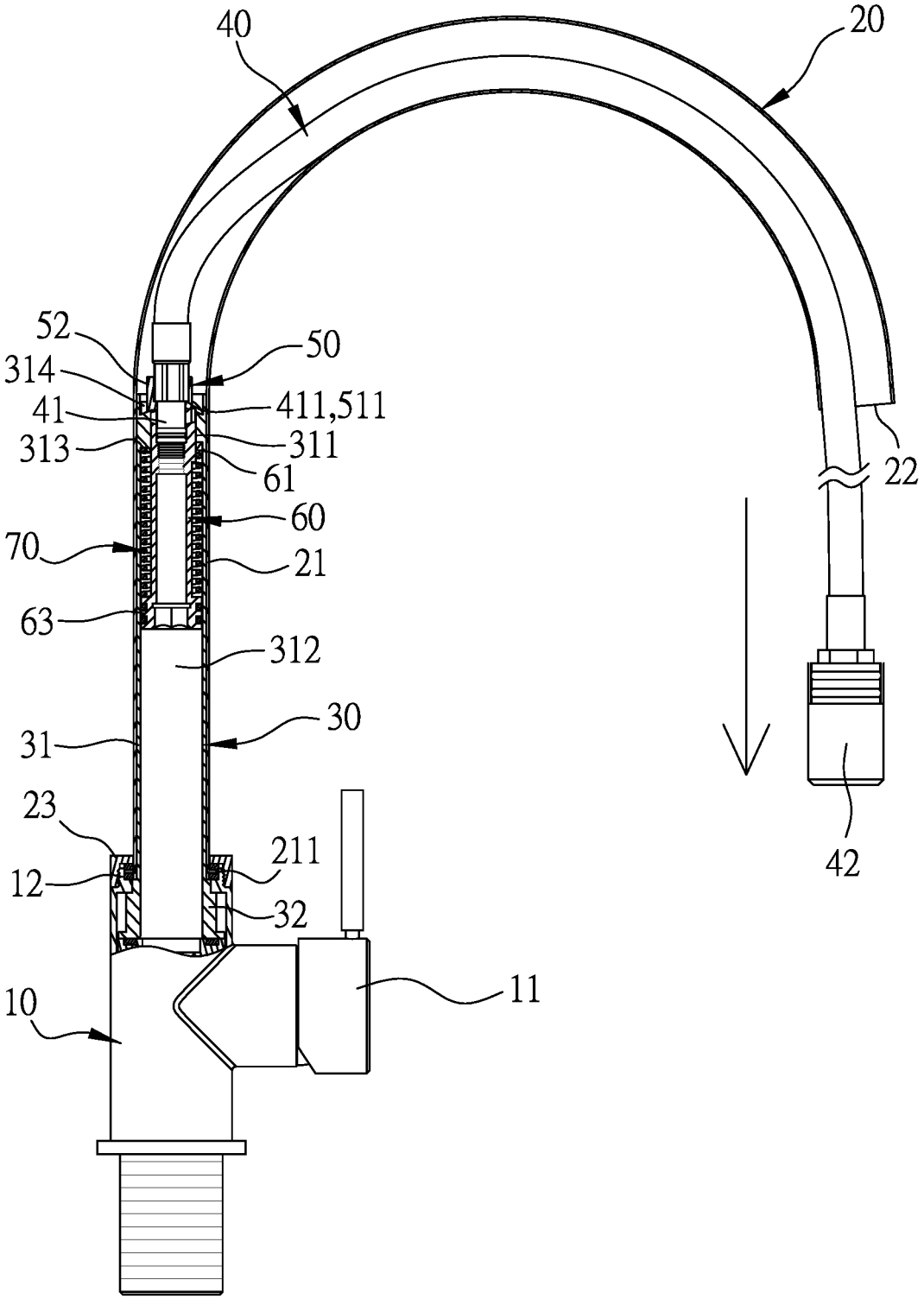
FIG. 7 is a cross-sectional view showing the operation of the positioning hose structure for the pull-out faucet according to the preferred embodiment of the present invention.
Figure 8:
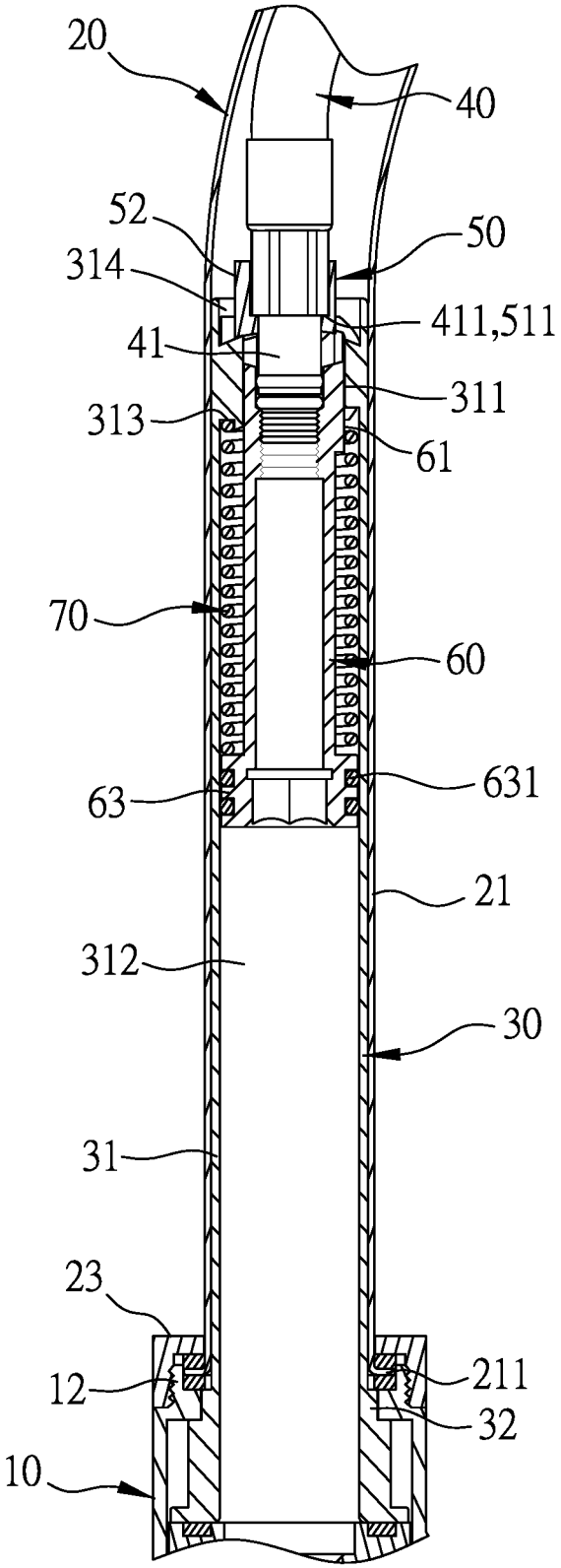
FIG. 8 is an amplified cross-sectional view of a part of FIG. 7.
Figure 9:
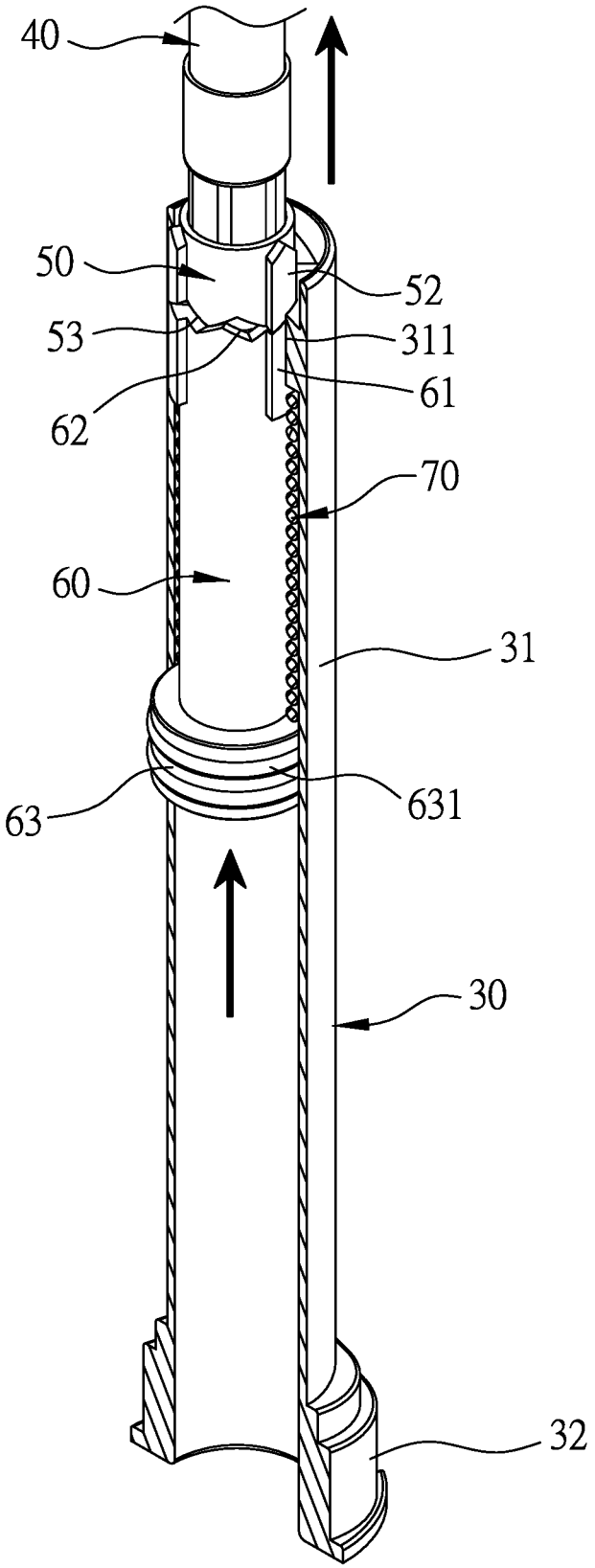
FIG. 9 is a cross-sectional perspective view showing the operation of the positioning hose structure for the pull-out faucet according to the preferred embodiment of the present invention.
Figure 10:
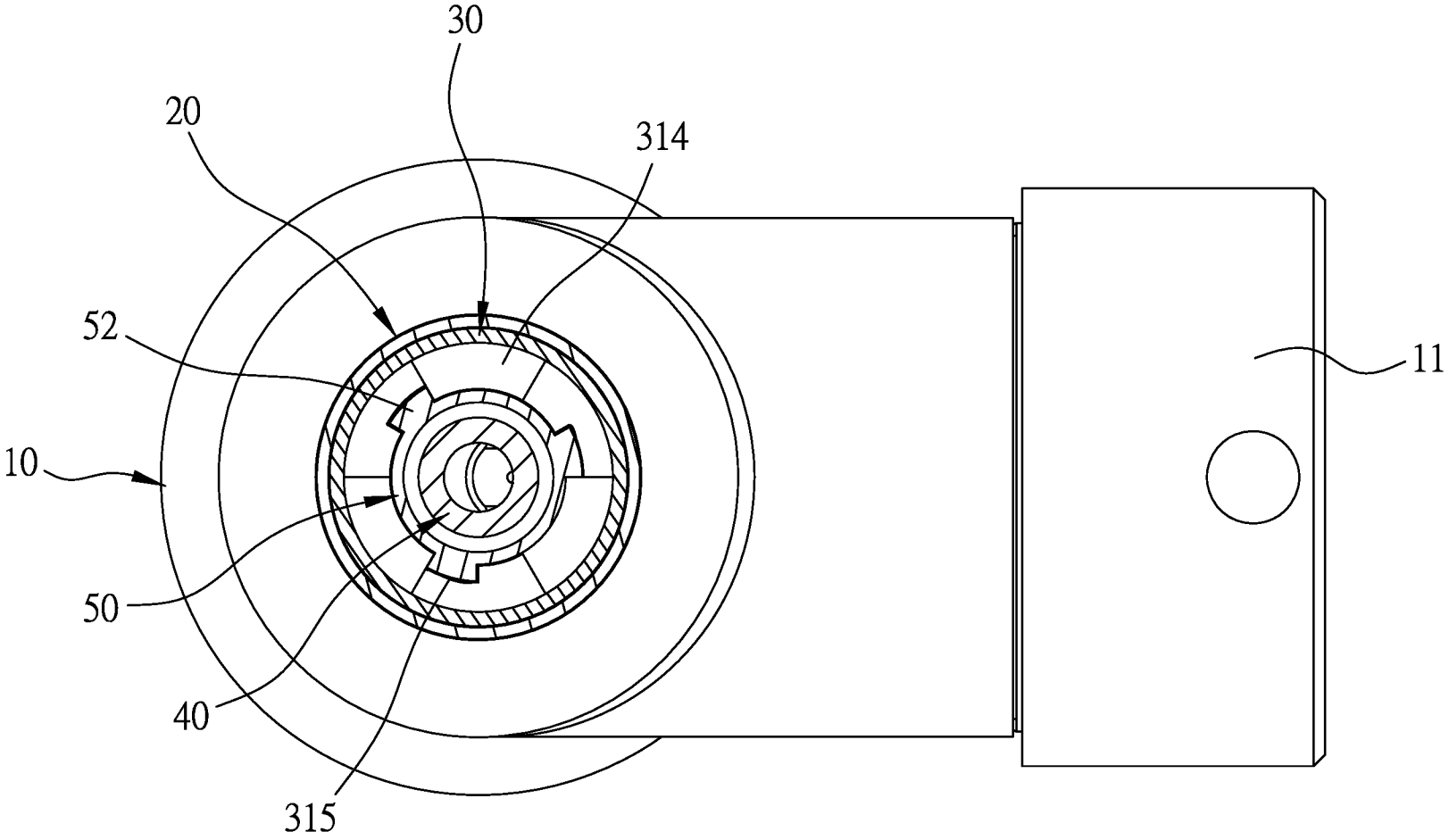
FIG. 10 is another cross-sectional perspective view showing the operation of the positioning hose structure for the pull-out faucet according to the preferred embodiment of the present invention.
Figure 11:
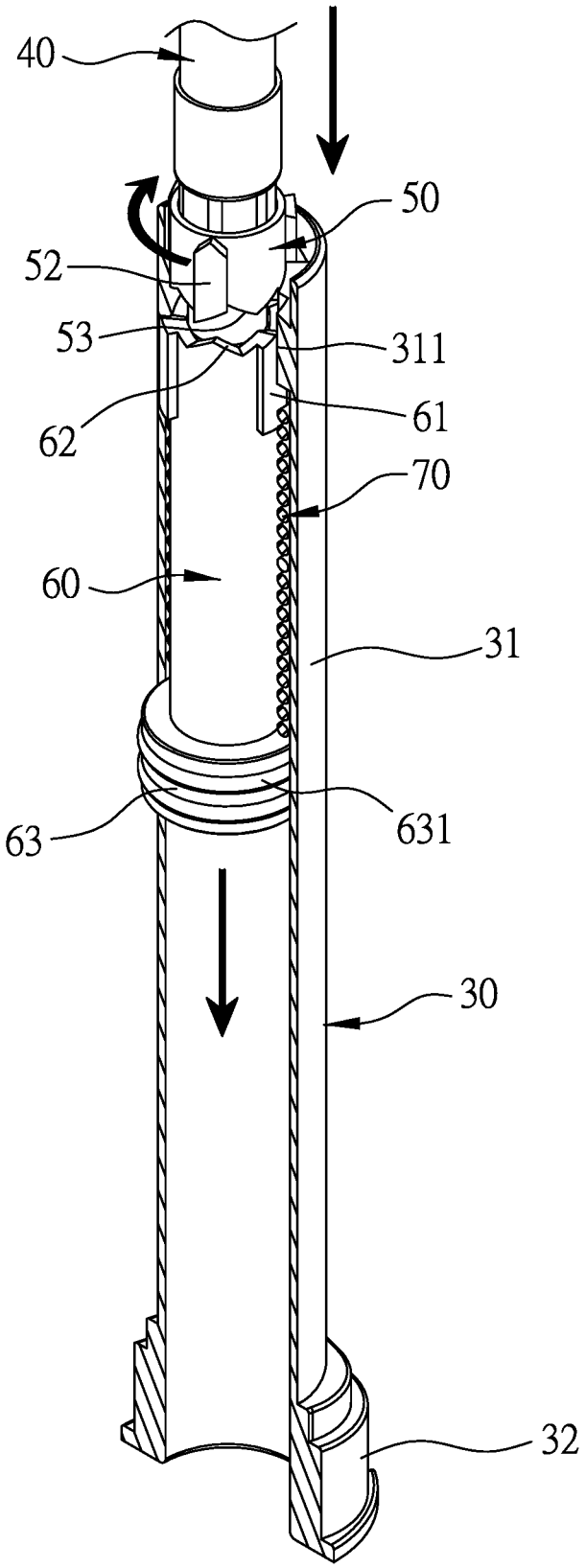
FIG. 11 is also another cross-sectional perspective view showing the operation of the positioning hose structure for the pull-out faucet according to the preferred embodiment of the present invention.
Figure 12:
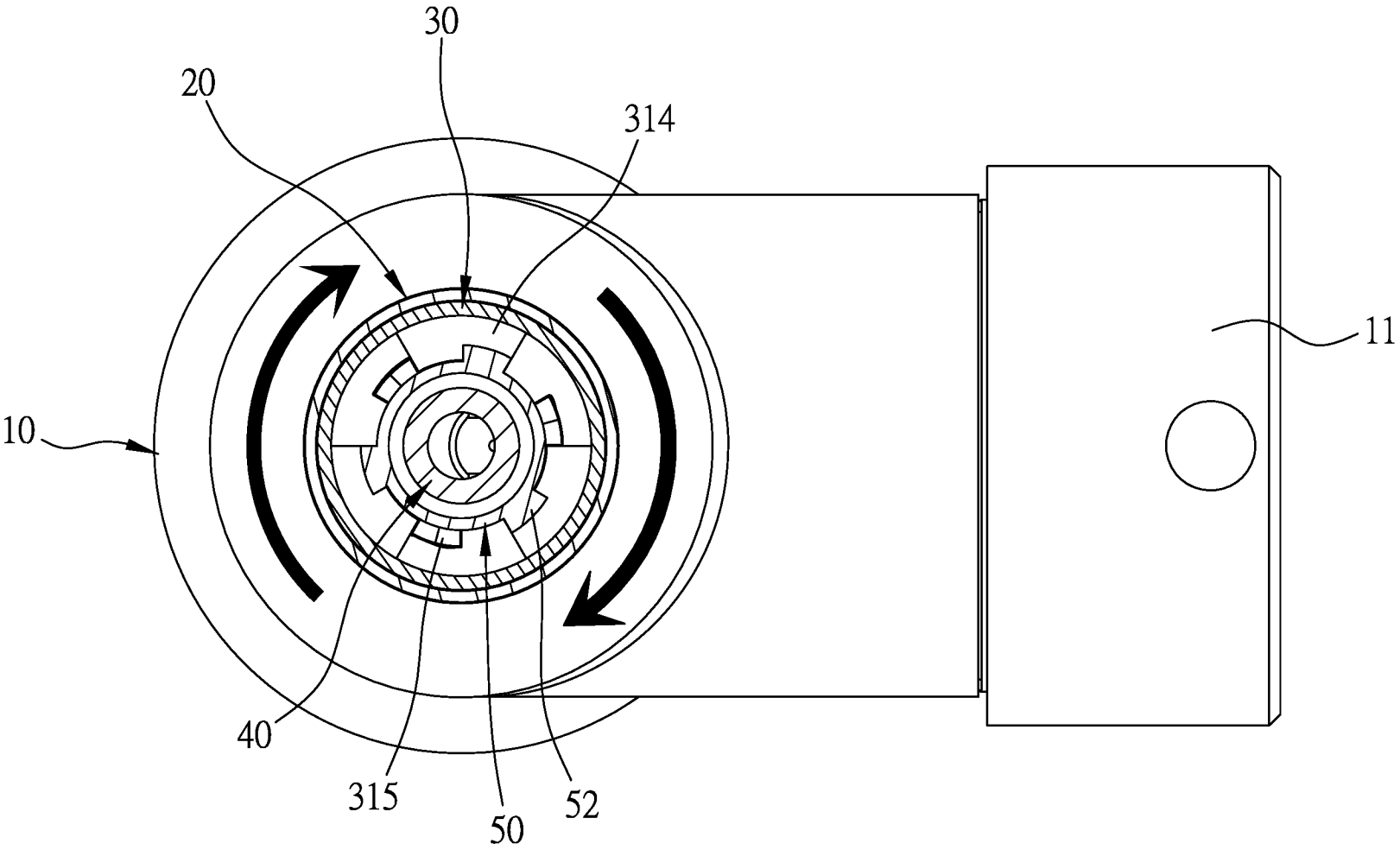
FIG. 12 is still another cross-sectional perspective view showing the operation of the positioning hose structure for the pull-out faucet according to the preferred embodiment of the present invention.

When using the movable structure of the faucet outlet pipe in a normal water supply mode, the control portion 11 is applied to control a mixing ratio of cold water and hot water, a water supply, and a stopping of the water supply so that water flows out of the water supply head 42 of the flexible hose 40 via the body 10 and the flexible hose 40. When washing a countertop or other objects in a large area, as shown in FIGS. 7-12, the water supply head 42 is pulled outward with the flexible hose 40 to extend to a desired position in the large range, in the meantime, the slide member 60 is actuated by the flexible hose 40 to move upward, and the guide element 50 is pushed by the slide member 60 to move upward so that the spring 70 is driven by the protruded tab 63 of the slide member 60 to retract. The multiple first ribs 52 of the guide element 50 align with the multiple guiding slots 315 of the fitting sleeve 30 and slide upward, the multiple second ribs 61 of the slide member 60 are aligned with the multiple guiding slots 315 of the fitting sleeve 30 to slide upward until the multiple first ribs 52 of the guide element 50 remove from the multiple guiding slots 315 of the fitting sleeve 30, and the second toothed portion 62 of the slide member 60 pushes the first toothed portion 53 of the guide element 50 so as to urge the guide element 50 to directionally revolve at a small angle. The multiple first ribs 52 of the guide element 50 changeably align and engage with the multiple protrusions 314 of the fitting sleeve 30, and the stop ridge 411 of the joining portion 41 of the flexible hose 40 contacts with the positioning portion 511 of the fixing orifice 51 of the guide element 50 until the water supply head 42 is pulled and extend outward.

When desiring to retract the water supply head 42 inward, the water supply head 42 is further pulled outwardly with the flexible hose 40 so that the slide member 60 is actuated by the flexible hose 40 to move upward, and the second toothed portion 62 of the slide member 60 pushes the first toothed portion 53 of the guide element 50 to urge the guide element 50 to directionally revolve at the small angle. The multiple first ribs 52 of the guide element 50 changeably align and engage with the multiple guiding slots 315 of the fitting sleeve 30, thus releasing the water supply head. Then, the spring 70 urges the flexible hose 40, the guide element 50, and the slide member 60 to move back to original positions, and the water supply head 42 is retracted to engage with the opening 22 of the supply pipe 20.

Thereby, the positioning hose structure for the pull-out faucet of the present invention has following advantages:

1. The water supply head 42 is positioned automatically after being pulled outwardly, and the water supply head 42 is retracted back to the original position automatically after being pulled further, thus obtaining easy operation.

2. The fitting sleeve 30, the flexible hose 40, the guide element 50, the slide member 60, and the spring 70 are connected on the supply pipe 20, so a structure of the body 10 is not changed and its size is decreased to achieve easy fabrication and wide commonality.

3. The flexible hose 40 is not inserted through the body 10 so as to connect and maintain a faucet easily and to decrease a failure rate of a connection of the faucet.

While various embodiments in accordance with the present invention have been shown and described, it is clear to those skilled in the art that further embodiments may be made without departing from the scope of the present invention.

What is claimed is:

1. A positioning hose structure for a pull-out faucet comprising:

a body including a locking portion formed on a top of the body;

a supply pipe being hollow, and the supply pipe including an extension formed on a first end of the supply pipe, an opening defined on a second end of the supply pipe, a defining portion formed on a bottom of the extension, a screw element locked on an outer wall of the defining portion, wherein the defining portion is screwed with the outer threads of the locking portion of the body by using the screw element of the body;

a fitting sleeve including a hollow connection tube fitted with an inner wall of the extension of the supply pipe, wherein the connection tube has a through hole defined adjacent to an upper end thereof, a receiving orifice connecting and communicating with the coupling portion, a shoulder arranged on an upper end of the receiving orifice, multiple protrusions separately formed on an inner wall of the through hole, and multiple guiding slots, wherein a respective guiding slot is defined between any two adjacent protrusions;

a flexible hose slidably accommodated in the supply pipe, and the flexible hose including a joining portion formed on a first end of the flexible hose, wherein the joining portion has a stop ridge formed thereon and is inserted into the connection tube, the flexible hose further includes a water supply head arranged on a second end thereof and located outside the supply pipe, and the water supply head is engaged with the opening of the supply pipe and is pulled outward with the flexible hose;

a guide element includes a fixing orifice defined on a center of the guide element and configured to rotatably and movably fit with an outer wall of the joining portion of the flexible hose, wherein the fixing orifice has a positioning portion extending from a bottom of an inner wall of the fixing orifice, the guide element further includes multiple first ribs separately arranged around the guide element, and the guide element includes a first toothed portion successively formed on a bottom thereof;

a slide member formed in a hollow tube shape, slidably received in the connection tube, and including an inner wall of a top connected with the joining portion of the flexible hose, multiple second ribs separately arranged on an outer wall of the top of the slide member, a second toothed portion formed on the top of the multiple second ribs, and a protruded tab extending around a bottom of the slide member, contacting with and sliding along the inner wall of the connection tube; and a spring accommodated in the receiving orifice of the connection tube and fitted on outer sides of the flexible hose and the slide member, wherein a first end of the spring abuts against the shoulder of the upper end of the receiving orifice, and a second end of the spring contacts with the protruded tab of the bottom of the slide member.

2. The positioning hose structure as claimed in claim 1, wherein the locking portion of the body has outer threads formed on an outer wall thereof, and the screw element has inner threads defined on an inner wall thereof, such that the inner threads of the screw element are screwed with the outer threads of the locking portion of the body so that the supply pipe is connected with the body.

3. The positioning hose structure as claimed in claim 1, wherein the defining portion of the supply pipe is circularly protruded, and two first seal rings are fitted on an upper end and a lower end of the defining portion respectively to stop water.

4. The positioning hose structure as claimed in claim 1, wherein the protruded tab of the slide member has at least one second seal ring.

5. The positioning hose structure as claimed in claim 1, wherein the body includes a connecting portion arranged on an inner wall of the top thereof, and the fitting sleeve includes a coupling portion extending from a bottom of the connection tube and fitted with the connecting portion of the body.

* * * * *